US009757852B2

(12) United States Patent
Huang

(10) Patent No.: US 9,757,852 B2
(45) Date of Patent: Sep. 12, 2017

(54) WORK STOOL

(71) Applicant: HIEVER CO., LTD., Taichung (TW)

(72) Inventor: Tony Huang, Taichung (TW)

(73) Assignee: HIEVER CO., LTD., Taichung (TW)

( * ) Notice: Subject to any disclaimer, the term of this patent is extended or adjusted under 35 U.S.C. 154(b) by 63 days.

(21) Appl. No.: 14/849,024

(22) Filed: Sep. 9, 2015

(65) Prior Publication Data

US 2017/0066121 A1 Mar. 9, 2017

(51) Int. Cl.

| | |
|---|---|
| ***B25H 1/00*** | (2006.01) |
| ***A47C 7/00*** | (2006.01) |
| ***A47C 7/62*** | (2006.01) |
| ***A47C 3/30*** | (2006.01) |
| ***A47C 7/72*** | (2006.01) |
| ***A47C 9/02*** | (2006.01) |

(52) U.S. Cl.

CPC ..... *B25H 1/00* (2013.01); *A47C 3/30* (2013.01); *A47C 7/004* (2013.01); *A47C 7/006* (2013.01); *A47C 7/62* (2013.01); *A47C 7/725* (2013.01); *A47C 9/02* (2013.01)

(58) Field of Classification Search

CPC .. B25H 1/00; A47C 3/30; A47C 7/004; A47C 7/006; A47C 7/62; A47C 7/25; A47C 7/752

USPC ..... 297/344.19

See application file for complete search history.

(56) References Cited

U.S. PATENT DOCUMENTS

| | | | | |
|---|---|---|---|---|
| D365,935 | S | 1/1996 | Dallas | |
| 6,012,775 | A * | 1/2000 | Czarnecki | A47C 3/30 297/344.19 |
| 7,530,639 | B2 * | 5/2009 | Groelsma | A47C 1/03255 297/344.18 X |
| 8,931,848 | B2 * | 1/2015 | Archambault | B60N 3/063 297/423.25 |
| 2008/0048472 | A1 * | 2/2008 | Kuenzel | A47C 3/30 297/344.19 |

* cited by examiner

*Primary Examiner* — Anthony D Barfield

(74) *Attorney, Agent, or Firm* — Muncy, Geissler, Olds & Lowe, P.C.

(57) ABSTRACT

A work stool includes a support whose one end has a cushion and an opposite end has a base. The base has a bottom provided with a plurality of casters. The support has a gas strut. A tray is mounted around the support and positioned between the cushion and the base. A connecting assembly has one end fixedly connected to the tray and has an opposite end connected to the gas strut so that a distance between the tray and the cushion is fixed and the tray is adjustable in terms of altitude by operating the gas strut.

7 Claims, 7 Drawing Sheets

WORK STOOL

BACKGROUND OF THE INVENTION

1. Technical Field

The present invention relates to facilitators for maintenance and repair, and more particularly to a work stool.

2. Description of Related Art

For allowing automobile mechanics to perform works and access tools conveniently, some work chairs have been introduced, such as the one disclosed in U.S. Pat. No. D365,935. The known device has a support that adjustably holds up a cushion in terms of altitude. The support stands on a base. The base has its bottom equipped with casters and has its top formed as a tray for carrying tools. Such a chair is provided for a user to change his/her location without leaving the chair and to access tools in the tray.

Nevertheless, the known chair has its shortcomings. For instance, when the cushion is lifted to a higher altitude, the tray remains unmoved, and this makes the distance between the cushion and the tray increase, meaning that a user sitting on the cushion has to bend his/her body more to access the tools in the tray as compared to the case where the cushion is positioned low. Hence, the prior art needs to be improved.

BRIEF SUMMARY OF THE INVENTION

The objective of the present invention is thus to provide a work stool allowing a user to access tools conveniently.

For achieving the foregoing objective, the disclosed work stool comprises a support that has one end provided with a cushion and an opposite end provided with a base. The base bottom has a plurality of casters. The support has a gas strut. A tray is mounted around the support so as to be positioned between the cushion and the base. A connecting assembly has one end fixedly connected to the tray and an opposite end connected to the gas strut so that a distance between the tray and the cushion is fixed and the tray is adjustable in terms of altitude by operating the gas strut.

DETAILED DESCRIPTION OF THE INVENTION

Figure 1:
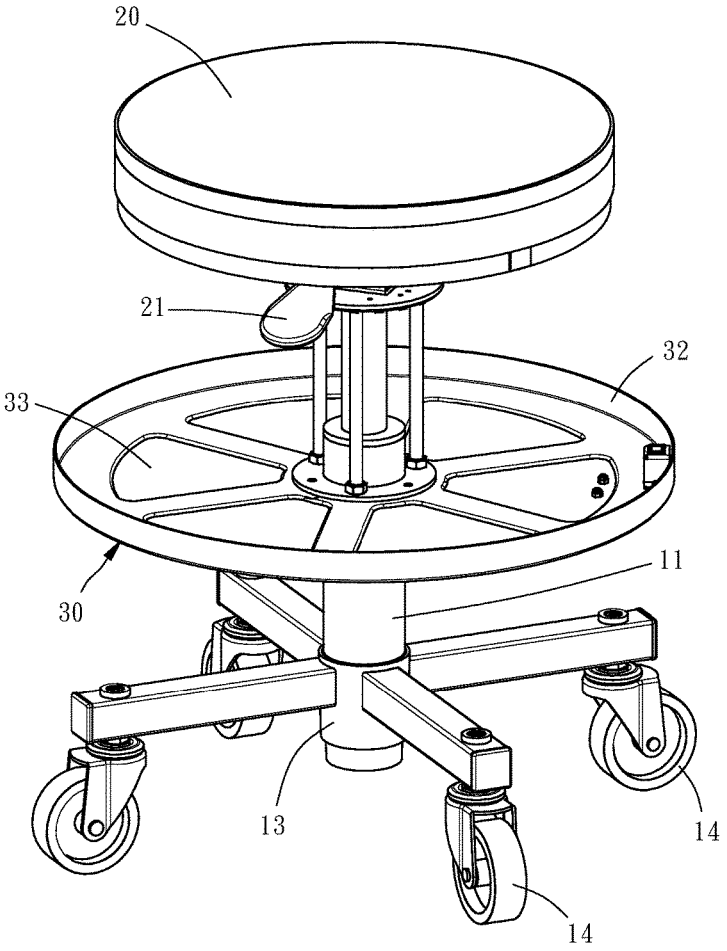
FIG. 1 is a perspective view of the present invention.
Figure 2:
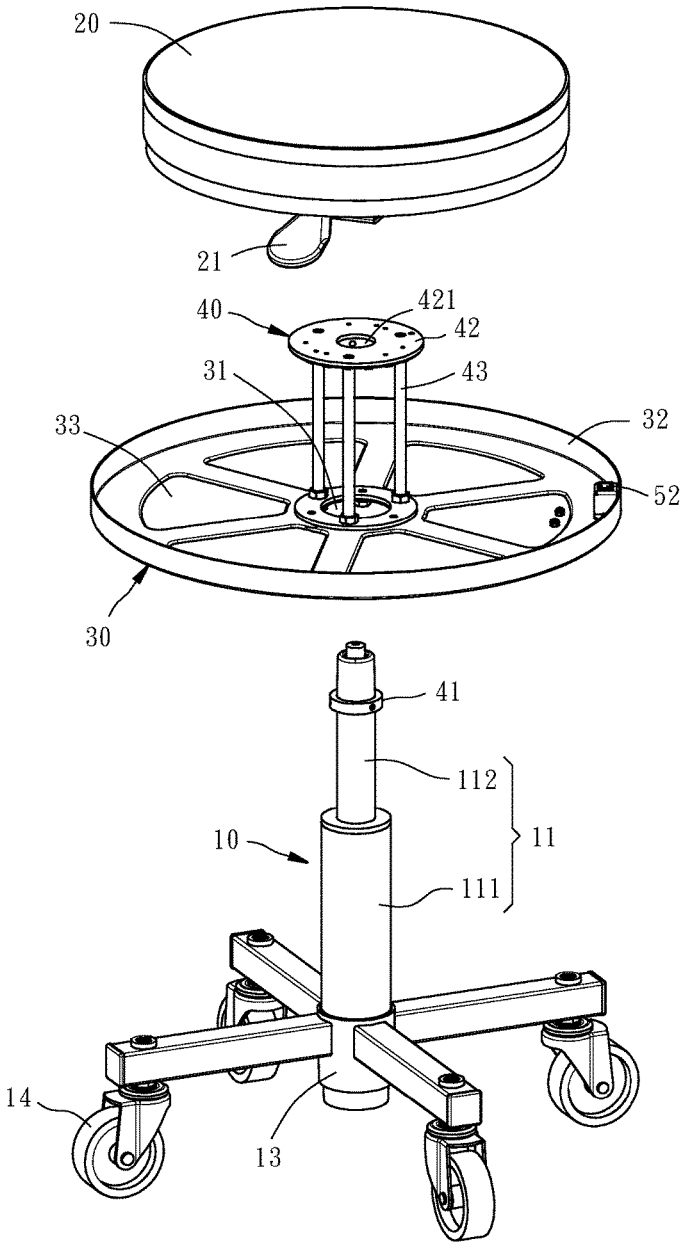
FIG. 2 is an exploded view of the present invention.

As shown in the drawings, according to the present invention, a work stool comprises a support (10), a cushion (20), a tray (30) and a connecting assembly (40).

The support (10) has a central post (11). The central post (11) is a gas strut. The central post (11) has its lower end provided with a base (13). The base (13) has a bottom provided with a plurality of casters (14). In the present embodiment, the base includes four legs. However, the base may be alternatively composed of three or five legs, or composed of a foundation plate, without limitation. In the present embodiment, each of the legs is equipped with a caster (14).

The cushion (20) is attached to an upper end of the gas strut. The cushion (20) has a control lever (21) attached thereto from below, for controlling the gas strut to expand or retract. As the control operation is known as that performed on common gas-strut chairs, the details thereof will not be discussed in any length herein.

The tray (30) has a through hole (31). The tray (30) is mounted around the central post (11) of the support by means of the through hole (31) so that the tray (30) is positioned between the cushion (20) and the base (13). The tray (30) has a peripheral wall (32) surrounding its bottom (33), so as to form the tray (30) as a basin-like receptacle.

The connecting assembly (40) serves to connect the tray (30) and the gas strut together so that the tray (30) moves as the gas strut expands or retracts and is rotatable about the central post (11). The connecting assembly (40) is mounted around the central post (11) with one end fixedly connected to the tray (30) and an opposite end connected to the gas strut. With the connecting assembly (40), the tray (30) is adjustable in terms of altitude by operating the gas strut and is rotatable about the central post (11). In the present embodiment, the connecting assembly comprises a fixed ring (41), a rotating ring (42) and a plurality of connecting sticks (43). The fixed ring (41) is fixed to the gas strut. The rotating ring (42) has a through hole (421) whose diameter is smaller than an outer diameter of the fixed ring (41). The rotating ring (42) is mounted around the gas strut by means of the through hole (421) so that it is positioned on the fixed ring (41) and between the fixed ring (41) and the cushion (20). Each of the connecting sticks (43) has one end fixedly connected to the rotating ring (42) and an opposite end fixedly connected to the tray (30), so that the tray (30) is hung over the fixed ring (41) by means of the rotating ring (42) and is rotatable about the central post (11). The central post (11) has a lower post (111) and an upper post (112) retractable and extendible relative to the lower post (111). The fixed ring (41) is fixedly mounted to the upper post (112). The tray (30) is slidably sleeved onto the lower post (111) in a way that the lower post (111) extends through the through hole (31) of the tray (30).

Figure 3:
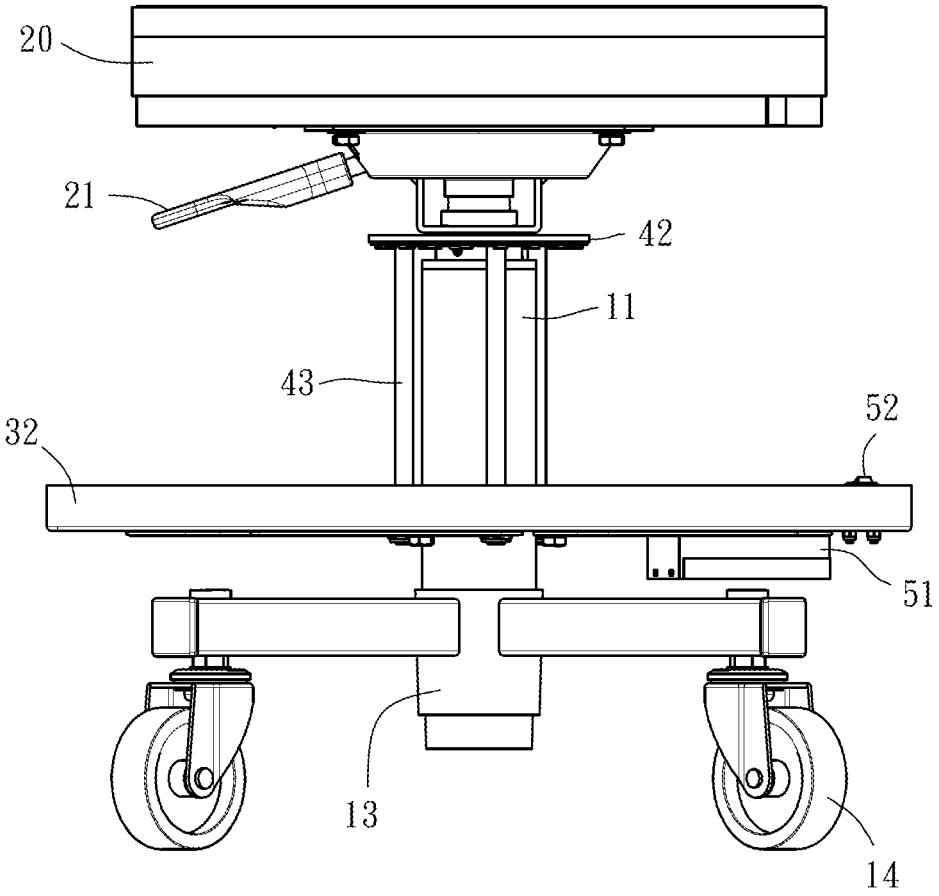
FIG. 3 is a lateral view of the present invention, showing the cushion positioned low.
Figure 4:
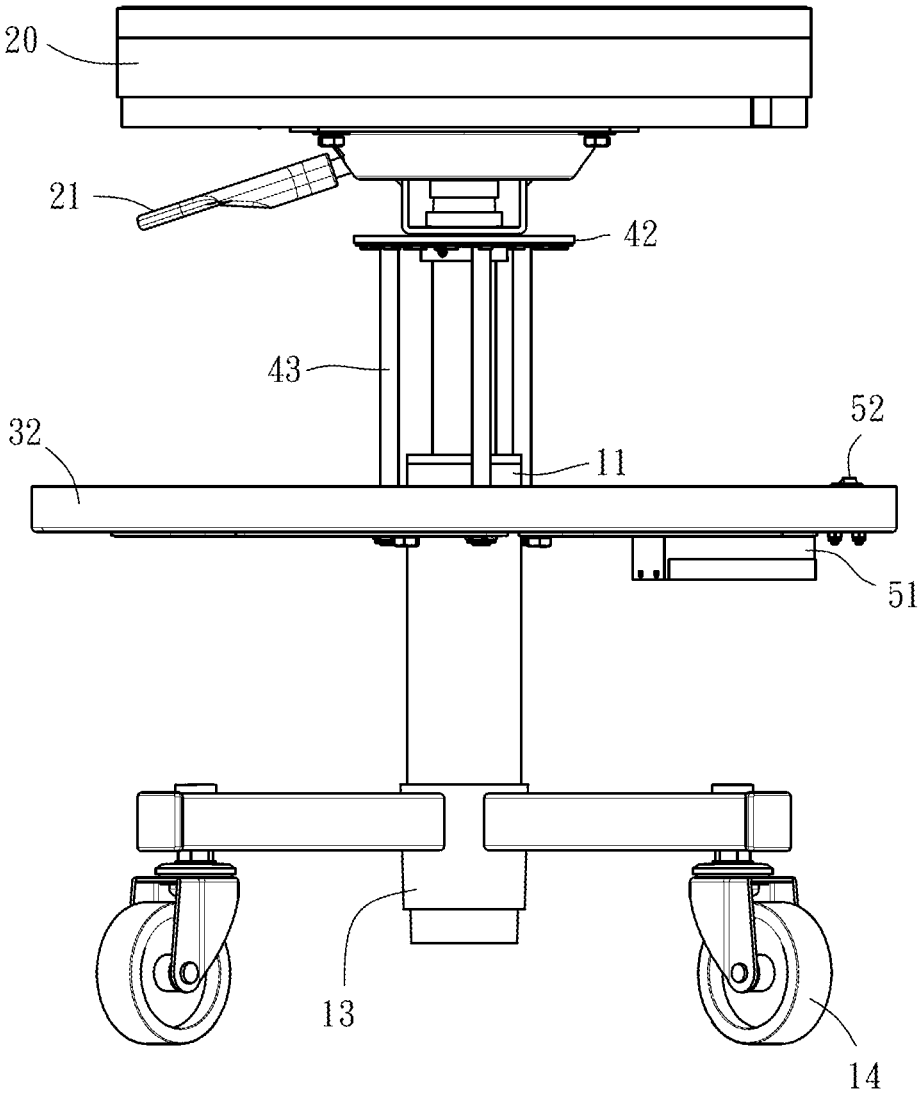
FIG. 4 is a lateral view of the present invention, showing the cushion positioned high.
Figure 5:
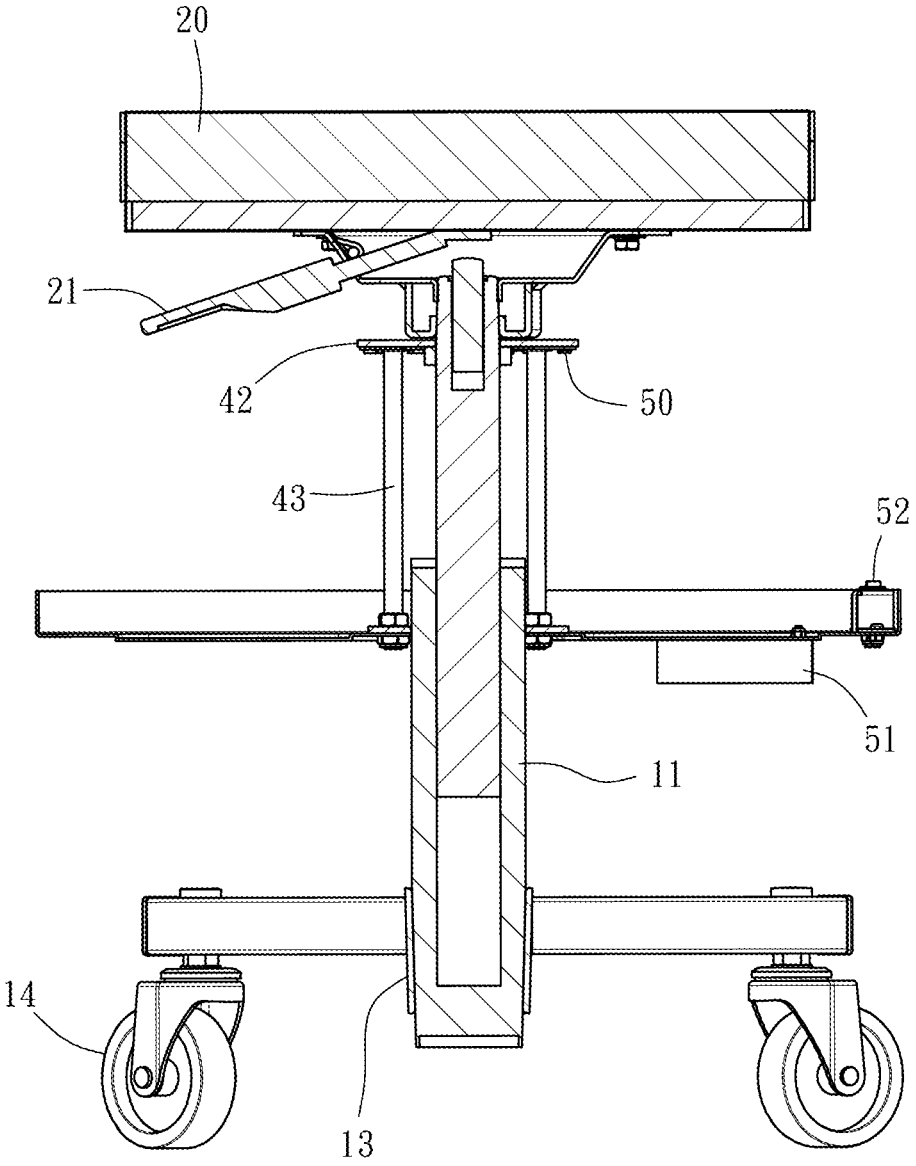
FIG. 5 is a vertical cross-sectional view of the present invention.
Figure 6:
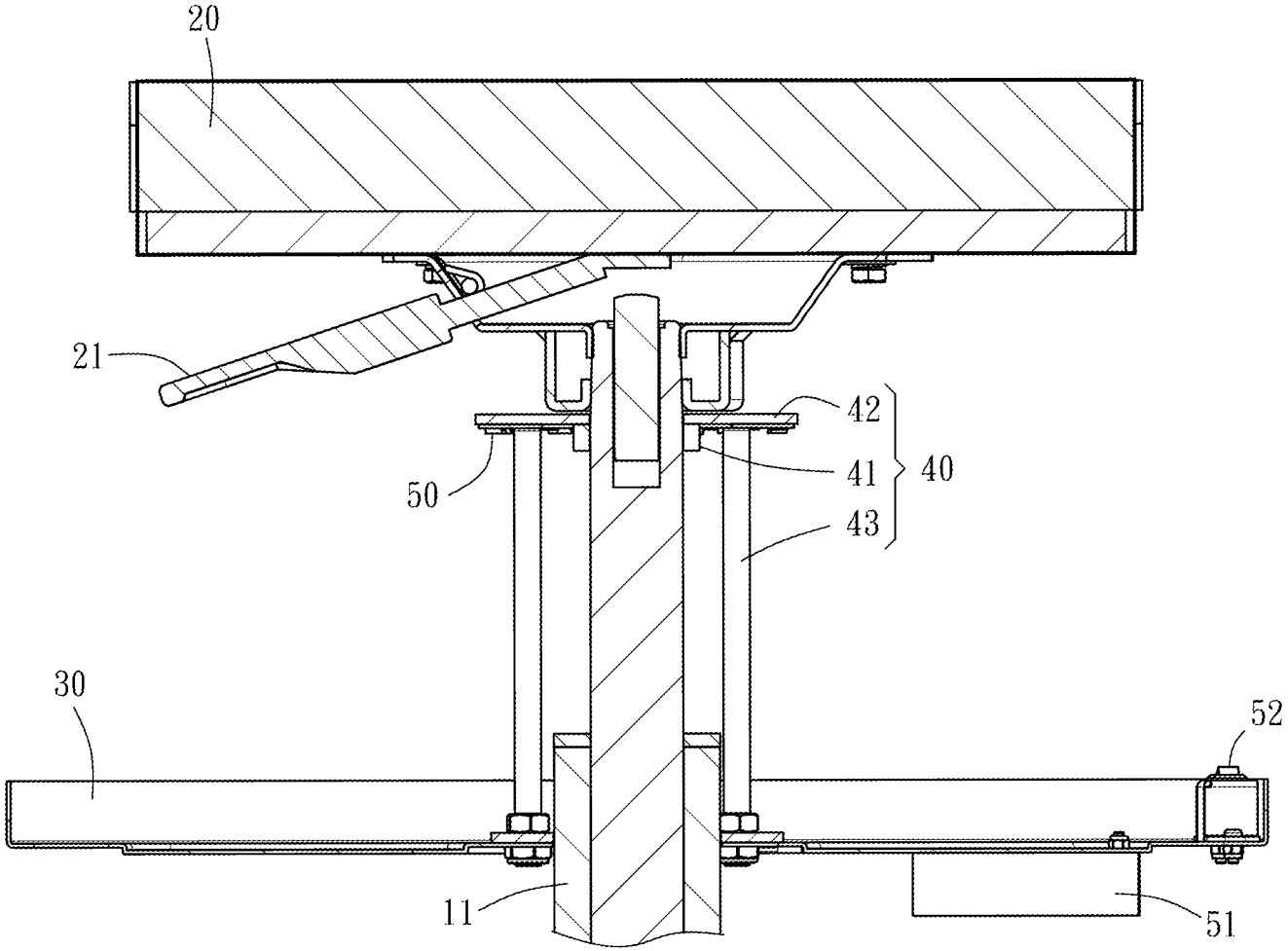
FIG. 6 is an enlarged view of the cushion, the connecting assembly and the tray of FIG. 5.
Figure 7:
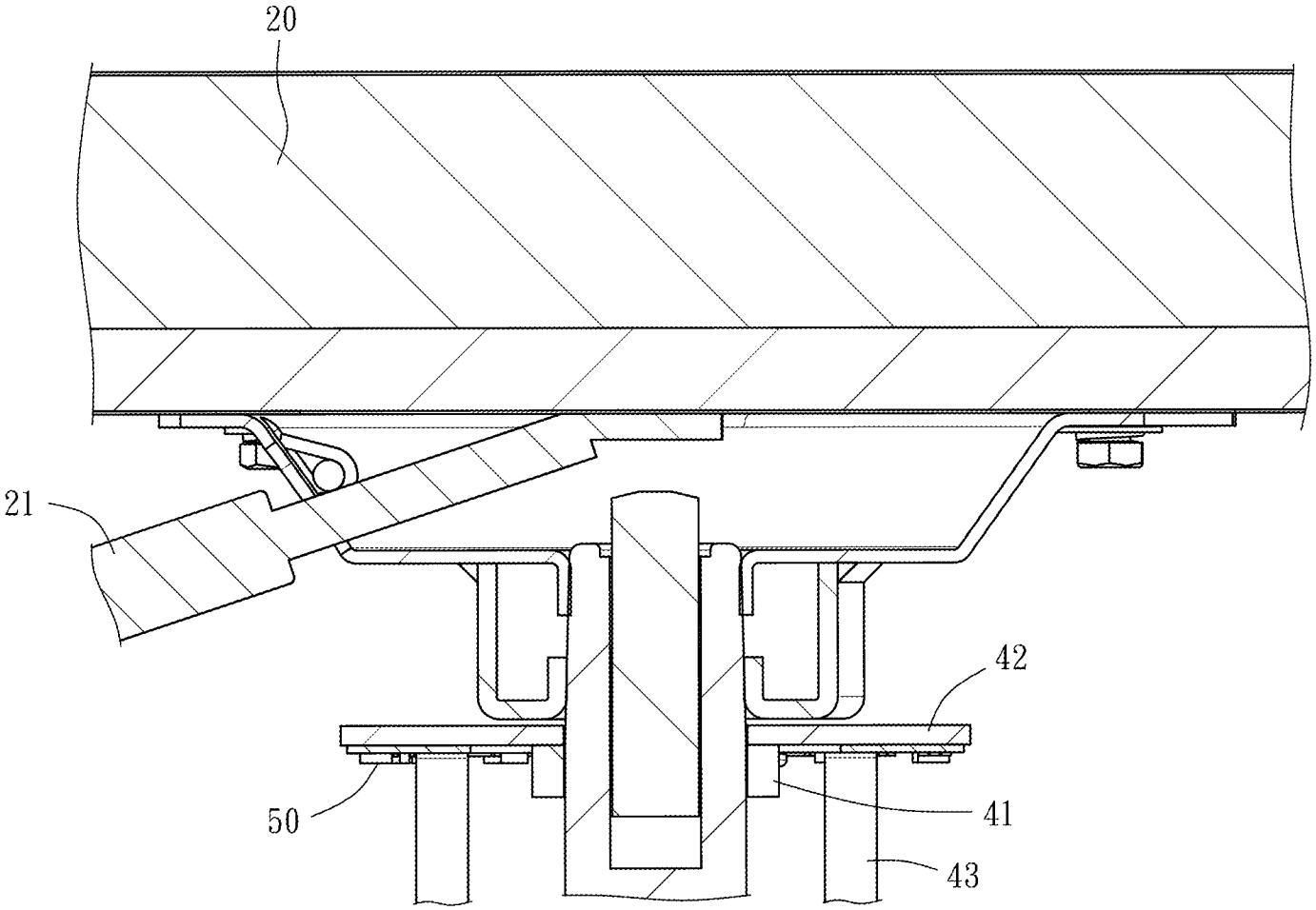
FIG. 7 is an enlarged view of the cushion and the connecting assembly of FIG. 5.

With the configuration given above, the disclosed work stool provides the cushion (20) for a user to sit, and the casters (14) below the base (13) enable the user to move the stool conveniently. Meanwhile, the tray (30) can move with the gas strut as the later expands or retracts. Where the gas strut retracts, the cushion (20) moves downward, and the tray (30) also moves downward to approach the base (13), as shown in FIG. 3. When the gas strut expands, the cushion (20) moves upward, and the tray (30) is lifted, as shown in FIG. 4. Therefore, the distance between the tray (30) and the cushion (20) is fixed without change, thereby facilitating the users' access to tools placed in the tray (30).

In addition, for furthering convenience and practicality in use, the work stool may be provided with lighting. As shown in FIGS. 1, 5, 6 and 7, on a lateral of the rotating ring (42) facing the tray (30), there may be one or more light emitting diodes (LEDs) (50), so as to illuminate the tray (30) as needed. The LEDs (50) are wired through the connecting stick (43) to a control box (51) below the tray (30). The control box (51) is equipped with a power switch (52). In the present embodiment, the power switch (52) is located on the tray (30) for users' convenient operation. The control box (51) contains a battery set that powers the LEDs (50). Of course, the LEDs may be powered in ways other than the battery set. For example, the LEDs may be powered by an external power source.

While the connecting assembly in the illustrated embodiment is composed of a fixed ring (41), a rotating ring (42) and a plurality of connecting sticks (43), it is to be noted that this forms no limitation to the present invention and the same function can be achieved by using, for example, a bearing and connecting sticks.

What is claimed is:

1. A work stool, comprising:

a support, having a central post, the central post being a gas strut, the central post of the support having a lower end provided with a base, the base having a bottom provided with a plurality of casters;

a cushion, being attached to an upper end of the gas strut, the cushion being equipped with a control lever for operating the gas strut to expand or retract;

a tray, being mounted around the central post; and a connecting assembly, serving to connect the tray and the gas strut so as to allow the tray to move as the gas strut expands or retracts, wherein the connecting assembly comprises a fixed ring, a rotating ring, and a plurality of connecting sticks, the fixed ring being fixed to the gas strut, the rotating ring having a through hole, the rotating ring being mounted around the gas strut by means of the through hole so as to be positioned on the fixed ring and between the fixed ring and the cushion, wherein each of the connecting sticks has one end fixedly connected to the rotating ring and an opposite end fixedly connected to the tray, wherein the tray has a through hole, and the tray is mounted around the central post by means of the through hole, wherein the tray has a bottom and a peripheral wall surrounding the bottom, wherein the central post has a lower post and an upper post retractable and extendible relative to the lower post, and wherein the fixed ring of the connecting assembly is fixedly mounted to the upper post; the tray is slidably sleeved onto the lower post in a way that the lower post extends through the through hole of the tray.

2. The work stool of claim 1, wherein the through hole of the rotating ring has a diameter smaller than an outer diameter of the fixed ring.

3. The work stool of claim 1, wherein the rotating ring is provided with one or more light emitting diodes (LEDs) facing the tray.

4. The work stool of claim 3, wherein the tray is equipped with a control box in which a power switch is provided for controlling the one or more light emitting diodes (LEDs).

5. The work stool of claim 1, wherein the base includes four legs and the casters are attached to bottoms of the legs.

6. The work stool of claim 5, wherein each of the legs has the bottom thereof provided with one said caster.

7. The work stool of claim 2, wherein the base includes a foundation plate and the casters are attached to a bottom of the foundation plate.

* * * * *